US005725091A

United States Patent [19]

Knoebel

[11] Patent Number: 5,725,091

[45] Date of Patent: Mar. 10, 1998

[54] VACUUM TOOTHBRUSH HOLDER

[76] Inventor: Norwood B. Knoebel, 13634 187th Pl. North, Jupiter, Fla. 33478

[21] Appl. No.: 623,140

[22] Filed: Mar. 28, 1996

[51] Int. Cl.[6] ..... B65D 85/20

[52] U.S. Cl. ..... 206/209.1; 206/362.1

[58] Field of Search ..... 206/209, 209.1, 206/361, 362, 362.1, 362.2, 524.8, 829; 99/472; 141/65

[56] References Cited

U.S. PATENT DOCUMENTS

| | | | |
|---|---|---|---|
| 1,347,194 | 7/1920 | Washington | 99/472 X |
| 3,371,260 | 2/1968 | Jackson et al. | 206/362.1 X |
| 3,769,902 | 11/1973 | Hurwitz | 99/472 |
| 3,884,635 | 5/1975 | Sloan . | |
| 3,915,525 | 10/1975 | Taube . | |
| 3,943,987 | 3/1976 | Rossi | 206/524.8 |
| 4,901,634 | 2/1990 | Kuwahara et al. | 206/524.8 X |
| 5,088,267 | 2/1992 | Gee | 141/65 X |
| 5,163,566 | 11/1992 | Hempel . | |
| 5,259,519 | 11/1993 | Lieberman . | |
| 5,297,677 | 3/1994 | Burian . | |
| 5,333,742 | 8/1994 | Piedmont . | |
| 5,377,824 | 1/1995 | Seymours . | |
| 5,440,774 | 8/1995 | Cole . | |
| 5,476,333 | 12/1995 | Matthews . | |

*Primary Examiner*—Jacob K. Ackun
*Attorney, Agent, or Firm*—McHale & Slavin, P.A.

[57] ABSTRACT

A toothbrush storage apparatus with an inner chamber accessible through a hinged and latched top, with toothbrushes being stored in an upright orientation inside the chamber. An electrically driven, vacuum producing air displacement mechanism is connected through a gating valve to the chamber to thereby produce a vacuum-sealed condition inside the inner chamber. This vacuum-sealed condition results in a secure and sanitary environment for storage of the toothbrushes. A visual indicator can also be included on the outside of the device to show the resulting relative state of the vacuum inside the chamber. This will allow a user to activate the air displacement mechanism via an external switch for a period sufficient to generate the desired vacuum seal.

14 Claims, 3 Drawing Sheets

VACUUM TOOTHBRUSH HOLDER

FIELD OF INVENTION

This invention relates to the storage of toothbrushes and in particular, a toothbrush holder having a centralized vacuum chamber.

BACKGROUND OF THE INVENTION

After a person uses a toothbrush, a storage problem is presented due to the personal nature of the toothbrush and the overall desire to keep it in a sanitary environment. After each use, the toothbrush is still wet and has an increased susceptibility to collecting germs, bacteria, and/or viruses. Bathrooms, where toothbrushes are typically used, are notorious for higher levels of airborne infectants. Moreover, when used traveling or outdoors, the wet bristles might also present an attractive surface for pestilent creatures. Accordingly, a protected environment for storing a toothbrush is needed which cannot be further penetrated by airborne particles or otherwise.

Various containers for storing toothbrushes have been proposed by the prior art which provide a hygienic or sanitary toothbrush holder. U.S. Pat. No. 5,377,824 discloses a container for storage of toothbrushes in an antiseptic liquid. U.S. Pat. Nos. 3,915,525; 4,854,457; 5,163,566; 5,259,519; and 5,297,677 disclose variations of open-air storage racks. U.S. Pat. No. 5,333,742 discloses a device for dispensing plastic bags which wrap around the bristles of the brush. U.S. Pat. No. 5,476,333 discloses a toothbrush head which contains a replaceable container of sterilizing solution. U.S. Pat. No. 3,884,635 discloses a container with dehydrating and sanitizing pellets suspended above a chamber which is exposed to the atmosphere to encourage air circulation through the chamber.

In each instance, the disclosed containers are exposed in some way to the atmosphere which may contain airborne bacteria, germs, viruses and/or pests. While disinfectants are provided in some cases, this in no guarantee that such airborne particles are being neutralized before contacting the brush. The alternative liquid storage system would be difficult to transport and require continual replacement of the internal fluid. Similarly, the bagging system would require a continual supply of bags—potentially three per day per person using the device.

Accordingly, a toothbrush storage device is needed which is capable of storing a plurality of toothbrushes in a sealed environment without further exposure to airborne contaminants. In particular, a vacuum sealed environment would provide an extremely effective barrier against exposure. Such a device should be relatively compact and easy to use, with pushbutton control for creation of a vacuum. The vacuum could be generated via an electric pump or made portable by use of batteries. The storage compartment need be of a size to hold at least two toothbrushes and sufficiently sealed to hold the vacuum until the next use.

SUMMARY OF THE INVENTION

The instant invention is a storage container for toothbrushes with a vacuum chamber. The chamber includes a plurality of receiving apertures for supporting toothbrushes in an upright position. The chamber is accessible through a hinged lid having a sealing mechanism for maintaining a seal in the chamber once a motor creates a vacuum by the removal of air.

A switch located on the outside of the container is activated by the user which closes a circuit and provides power to a motorized vacuum pump. The pump is coupled to a mechanical, one-way valve placed on the bottom of the chamber which allows air to be evacuated from the chamber. The valve returns to a sealed position when the chamber is sufficiently evacuated and/or when the pump is de-activated. An indicator protrudes outward in its ambient state, and is drawn inward when the chamber is evacuated. The indicator provides a visual indication for the consumer. When a vacuum is created the switch can be deactivated allowing the seals to seal. It is recognized that only a partial vacuum can be achieved, but the displacement of air shall be considered a "vacuum" in this disclosure.

The toothbrushes are thereby stored in a sanitary, vacuum-sealed chamber to maintain a sanitary state until the next use. Upon releasing the lid latch, the vacuum seal is lost and the chamber fills with air thereby causing the rubber indicator to return to its ambient position. The toothbrushes can then be removed, used, and replaced, and the vacuum can be reestablished for further storage.

Therefore, it is an objective of the present invention to provide a toothbrush storage device employing a vacuum sealed chamber for sanitary storage of toothbrushes.

It is a related objective of the present invention to provide a switchable motorized vacuum pump and mechanical one-way valve for evacuating a chamber of air and generating a vacuum around the access lid.

It is still another objective of the present invention to provide a visual indicator which shows when a sufficient vacuum has been generated inside the storage chamber.

It is yet another objective of the present invention to provide a device which can be operated via either an AC wall plug or battery power.

It is a further objective of the present invention to provide a storage unit which can be used as either a counter-top or wall-mounted device.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
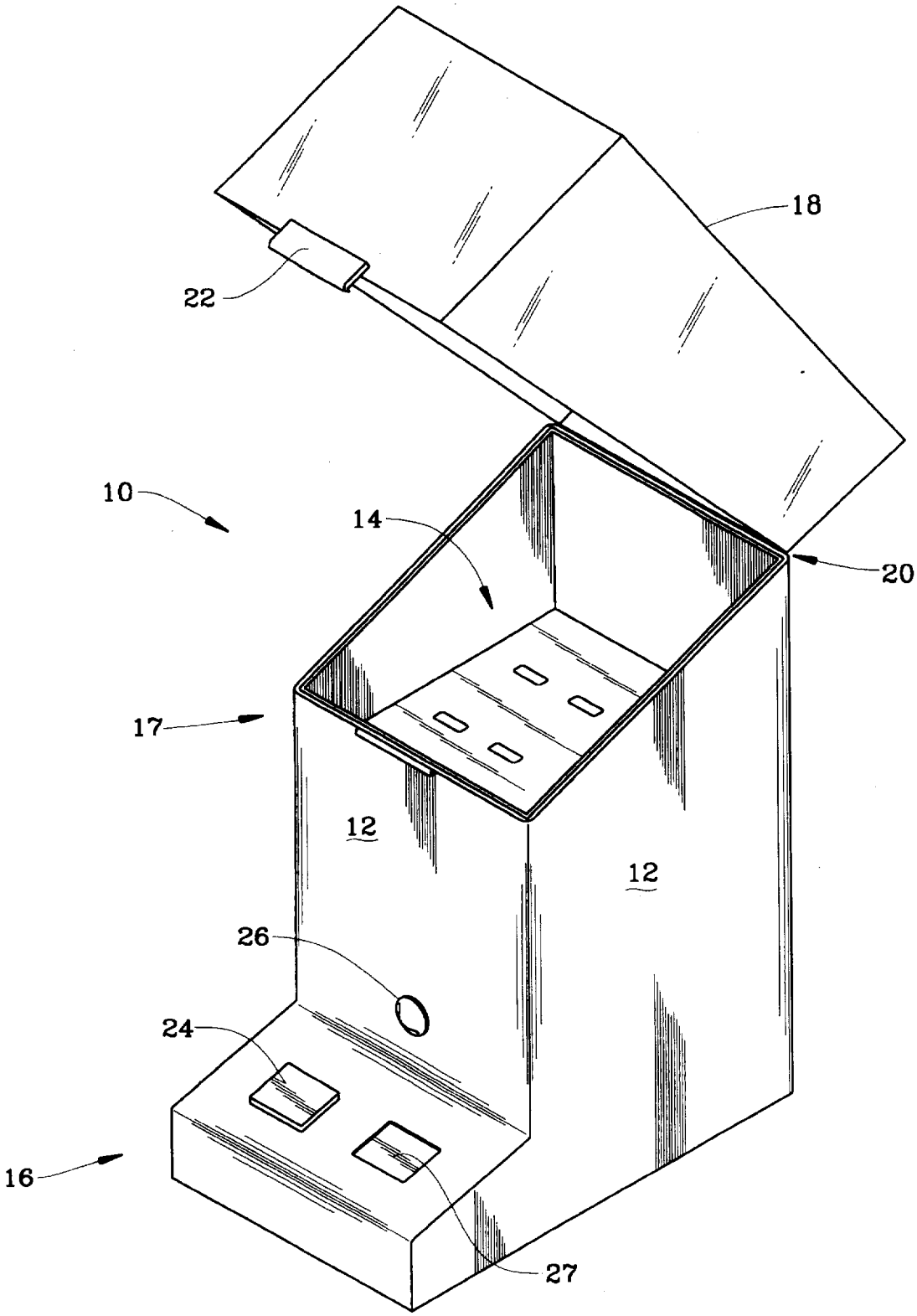
FIG. 1 shows a pictorial view of the toothbrush storage device.

Referring now to FIG. 1, a toothbrush storage device 10 is shown having a housing means set forth in the form of casing with an outer surface 12 composed a durable, opaque plastic. The device 10 has a lower base portion 16 which is wider than an upper portion 17 to promote stability of the device when used in an upright standing position. A separate top 18 is attached with a hinge 20 to the upper portion 17 so that the top tilts backwards. The hinged top provides access to an inner storage chamber 14 which is used for storing toothbrushes 21 in associated aperture holes (see FIG. 3) which receives the toothbrush handles 23 inside the chamber 14. The top 18 is typically made from a clear plastic to provide a functional and aesthetic viewing port to the brushes stored inside the chamber 14.

The top 18 has a latching mechanism 22 on its front for securing the top in its closed position. This mechanism 22 could include any type of latching device. In its simplest form, a hook and clasp might be used. Alternatively, a levering clasp similar to those used on lunchboxes and tackle boxes would provide a more downward sealing force, albeit with a more expensive mechanism. It will be obvious to one of ordinary skill in the art to recognize that the housing means is not limited by described and illustrated shape.

Figure 4:
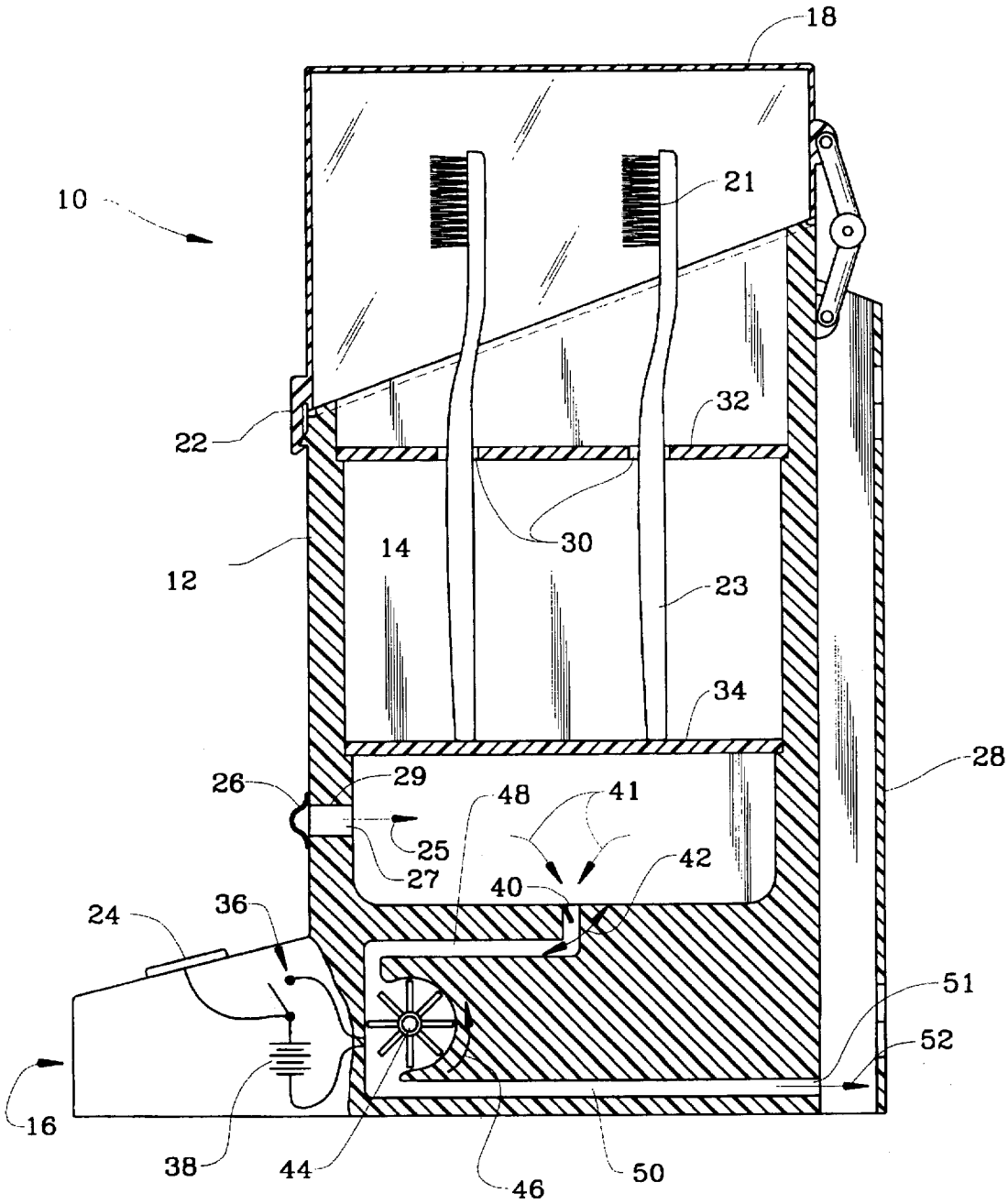
FIG. 4 shows a cross sectional view of the toothbrush storage device of FIG. 1 with the vacuum pump in the bottom of the unit.

The base portion 16 additionally includes an activation button 24 which activates a vacuum pump located within the base of the device (see FIG. 4). This pump evacuates the chamber 14 of air and thereby vacuum seals the top 18 down upon the upper portion 17 of the device 10. The front of the device 10 has a rubber, nipple-like indicator 26 sealably mounted over a through hole to the chamber 14. When the chamber is evacuated, the nipple is collapsably drawn inward to provide a visual indication to the user that a vacuum has been sufficiently generated inside the chamber. Alternatively, any such vacuum influenced indicator might be used, such as a spring loaded plunger or other such device. The base portion might also carry various brand or operation instruction labels 27, as shown.

When it is desired to remove a toothbrush 20 from storage, the latch 22 is released, thereby allowing air to enter the chamber 14. If the vacuum seal around the top is sound enough, sufficient pressure might need to be applied to the unlatched top to break the seal. Once the integrity of the vacuum inside the chamber is broken, the lid 18 can be freely lifted and the storage chamber 14 can be accessed.

Figure 2:
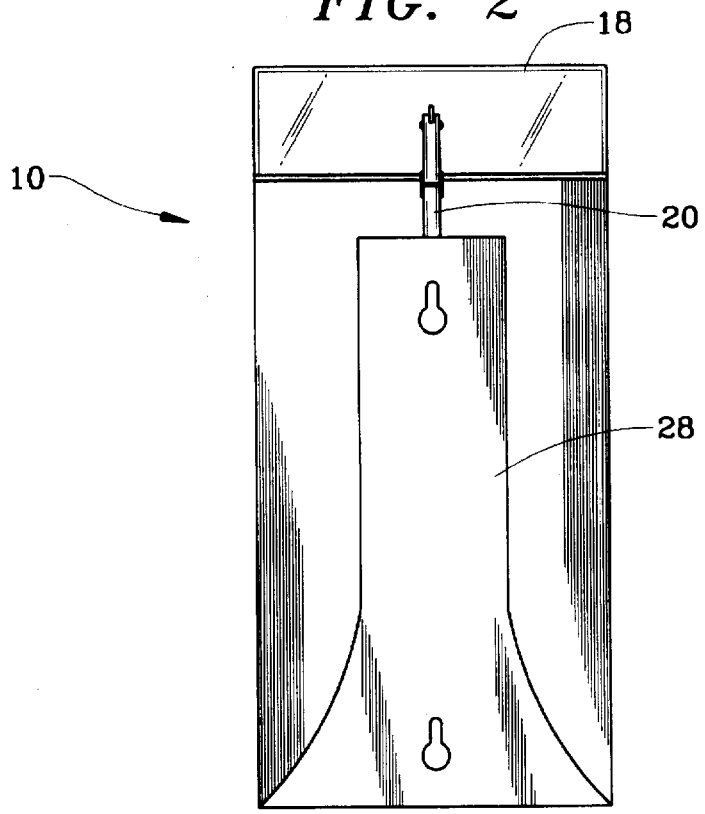
FIG. 2 shows a rear view of the toothbrush storage device of FIG. 1 with a wall mounting appendage.

Referring now to FIG. 2, a rear view of the device 10 is shown. A wall attachment fixture 28 is attached to the rear as an alternative means for vertically supporting the storage device. This would be particularly useful in areas where counterspace is limited, such as the edge of sinks. A series of attachment holes would fit over screws or nails placed in the wall.

Figure 3:
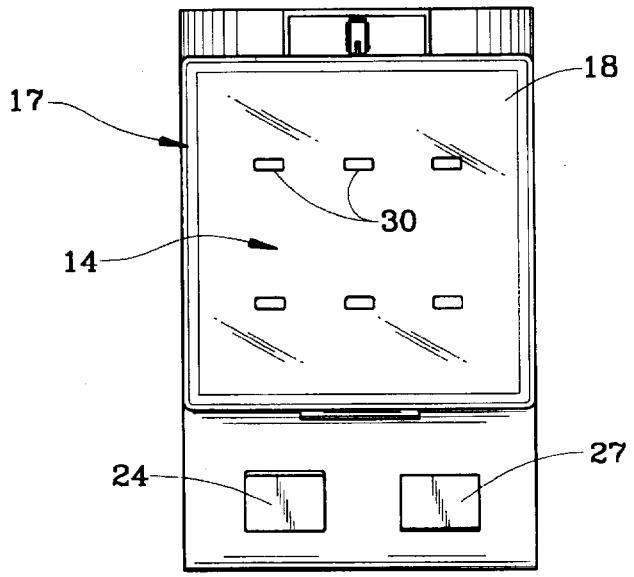
FIG. 3 shows a top view of the toothbrush storage device of FIG. 1.

FIG. 3 shows a top view of the storage device 10, which shows a set of aperture holes 30 located inside the chamber 14. The transparent top 18 sealably interacts with the upper portion 17 of the device 10. An upper view of the activation button 24 and labelling 27 is also shown.

Referring now to FIG. 4, a cross sectional view of the storage device 10 is shown. An upper shelf 32 spans the storage chamber 14 and has aperture holes 30 (shown in fathom) for receiving the toothbrush handles 23 as shown. A lower shelf 34 additionally spans the chamber 14 and supports the bottom ends of the handles 23. The nipple-like indicator 26 is affixed to the front outer surface 12 of the storage device as mounted over the through hole 29.

In the base portion 16, a multiple-finned positive displacement pump 44 is shown mounted in a passageway 48 leading from the bottom of the chamber 14. Between the chamber 14 and the passageway 48 is a one-way gating valve or flap 40 which allows air—as shown by arrows 41—to escape from the chamber. The valve or flap, however, does not allow backflow of this same air 41 back into the chamber. This valve might consist of a simple rubber flap—with memory—for returning to a closed position. As shown by the representative arrows 42, this flap moves up and down in response to pressure differences caused by the displacement 44. When the pressure is higher in the chamber 14 than in the passageway 48, the flap will be opened thereby allowing air to escape from the chamber 14. Eventually, as more air is drawn out and displaced by the displacement pump 44, the pressure inside the chamber will be relatively lower than the pressure in the passageway 48, thereby causing the flap to close. This will thereby create a vacuum sealed environment inside the chamber 14. Other more expensive and complicated valves might provide equal or better sealing results as needed.

The pump 44 is electrically powered and spins as depicted by arrow 46 when the electrical circuit is closed across the power source. In this embodiment, a battery 38 is shown which makes the device a stand-alone unit. Alternatively, an AC power cord (not shown) could supply external power to the pump 44. The activation button 24 closes the switch 36 thereby completing the circuit. The evacuated air 52 will continue to travel through an exhaust passageway 50 and out an exit port 51.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. A toothbrush storage apparatus comprising: a housing means having an inner chamber accessible by a moveable top, said inner chamber receivably containing toothbrushes therein, and a vacuum means incorporated within said housing means for evacuating air from said inner chamber, wherein a vacuum seal is achieved within said inner chamber for sanitary storage of said toothbrushes contained therein.

2. The toothbrush storage apparatus of claim 1, wherein said vacuum means includes an electrically powered positive displacement pump which draws air out of said inner chamber through a one-way gating valve.

3. The toothbrush storage apparatus of claim 2, wherein said gating valve includes a normally closed rubberized flap having a memory of said normally closed position.

4. The toothbrush storage apparatus of claim 2, wherein said housing means includes an activation switch for applying AC power to said displacement pump.

5. The toothbrush storage apparatus of claim 2, wherein said housing means includes an activation switch for applying DC power to said displacement pump from batteries contained within said outer casing.

6. The toothbrush storage apparatus of claim 1, wherein said top is hingably attached and includes a latching mechanism.

7. The toothbrush storage apparatus of claim 6, wherein said top is made from transparent plastic for viewing items stored within said inner chamber.

8. The toothbrush storage apparatus of claim 1, wherein said housing means includes a visual indicator means which is responsive to the vacuum condition produced within said inner chamber.

9. The toothbrush storage apparatus of claim 8, wherein said indicator means includes a rubberized nipple which flexes inward in response to the vacuum condition produced within said inner chamber.

10. The toothbrush storage apparatus of claim 8, wherein said indicator means includes a spring-loaded plunger which moves inward in response to the vacuum condition produced within said inner chamber.

11. The toothbrush storage apparatus of claim 1, wherein said housing means includes an expanded base portion to facilitate upright standing of said apparatus.

12. The toothbrush storage apparatus of claim 1, wherein said housing means includes a wall mounting fixture for attaching said storage apparatus to a wall.

13. A toothbrush storage apparatus comprising:

an outer plastic casing;

a transparent hinged and latched vacuum sealable top;

an inner storage chamber within said casing, said inner chamber receivably containing toothbrushes therein, with a one-way gating valve leading therefrom;

an electrically powered vacuum means incorporated within said casing for evacuating air from said inner chamber; and an activation switch for applying electrical power to said vacuum means;

wherein a vacuum seal is achieved within said inner chamber for sanitary storage of toothbrushes contained therein through activation of said vacuum means with said activation switch.

14. The toothbrush storage apparatus of claim 13, wherein said vacuum means includes a rotary positive displacement pump which draws air out of said inner chamber through said one-way gating valve.

* * * * *